US005620331A

United States Patent [19]

Los et al.

[11] Patent Number: 5,620,331

[45] Date of Patent: Apr. 15, 1997

[54] FEED-THRU IDC TERMINATOR

[75] Inventors: Oleg Los, Glenview; Jaime Duran; William L. Zuckerman, both of Chicago, all of Ill.

[73] Assignee: Methode Electronics, Inc., Chicago, Ill.

[21] Appl. No.: 356,685

[22] Filed: Dec. 15, 1994

[51] Int. Cl.[6] ..... H01R 9/09

[52] U.S. Cl. ..... 439/404; 439/76.1

[58] Field of Search ..... 439/67, 77, 404, 439/417, 420, 492, 499, 76.2, 76.1

[56] References Cited

U.S. PATENT DOCUMENTS 4,857,002 8/1989 Jensen et al. ..... 439/76.1

4,954,089 9/1990 Jensen et al. ..... 439/76

5,472,348 12/1995 Daly et al. ..... 439/76.1

5,507,654 4/1996 Daly et al. ..... 439/76.1

*Primary Examiner*—Neil Abrams

*Assistant Examiner*—Brian J. Biggi

*Attorney, Agent, or Firm*—David L. Newman

[57] ABSTRACT

A feed-thru IDC terminator is provided for simultaneously terminating a bus and connecting a bus to a peripheral device. A first end of the feed-thru connector includes IDC contacts and a second end of the feed-thru connector includes feed-thru contacts and a printed circuit board is mounted therebetween having termination circuitry thereon.

10 Claims, 1 Drawing Sheet

40
68
70
67
63
65
71
61
50
51
53
55
58
60
66
52
71
50
10
55
20
20
63
61
3
60
40
42
3
30

FEED-THRU IDC TERMINATOR

BACKGROUND OF THE INVENTION

This invention pertains to an electrical connector, including a terminator device and, in particular, it relates to a feed-thru insulation displacement connection (IDC) connector, including termination circuitry.

An application where reliable data transfers are important are in the field of data transmissions on a data bus transmission line for communication between a plurality of peripheral devices and a central processing unit in a small computer. For example, a small computer system interface (SCSI) bus provides for such a communication link. As is generally known in the art of designing bus transmission lines, a terminator, comprising of a resistor network, is typically connected to each of the physical ends of the bus in order to eliminate line reflection, created by the transmission of signals on the bus. Both of the terminators have a characteristic impedance equal to that of the bus.

Many peripherals, such as disk drives, are adapted to connect to the bus via flat ribbon cable. A bus terminator is generally attached to the flat ribbon cable, adjacent a peripheral device. FIG. 1 shows the common arrangement of the prior art, having an electrical connector having termination circuitry (a terminator) 10 attached to the flat cable 20. Adjacent the terminator 10, is an electrical connector 30 which is also attached to the flat ribbon cable 20. The electrical connector 30 provides for connection through a peripheral device such as a disk drive. Upon attachment of the electrical connector 30 to the peripheral device, it will then be attached to the bus via the flat ribbon cable 20 and terminated by the terminator 10, also attached to the ribbon cable 20. Both the terminator 10 and the electrical connector 30 are attached to the flat ribbon cable 20 via IDC connection. The process of attaching the terminator 10 and the electrical connector 30 is timely in that the ribbon cable 20 and the terminator 10 or electrical connector 30 must be carefully inserted in an Arbor press so that the IDC may be made between the rows of conductors of the ribbon cable 20 and the corresponding rows of the contacts of the terminator and electrical connector 30. Because the terminator 10 is separate from the electrical connector 30, the IDC process must be done twice.

In other prior art embodiments, the electrical connector 30 may be directly mated to a terminator which is in turn mated to a peripheral device. In such an arrangement, only a single IDC is necessary; however, misplacement of the terminator is possible. It is common to unplug the peripheral device from the bus. At such a time, the ribbon cable 20 having the electrical connector 30 attached thereto is separated from the peripheral device and the terminator is separated from both the cable 20 and the peripheral device. It is then not clear to most operators what to do with the loose terminator. Although it is preferable for the terminator to remain with the cable 20 in such an arrangement where the terminator is separate from the electrical connector 30, the two parts may easily be separated. Or the terminator may remain attached to the peripheral device and should attachment of the bus occur to another peripheral device, the termination may not be achieved at both ends of the bus.

Accordingly, there is desired an electrical connector terminator apparatus which avoids misplacement of a separate terminator and reduces the connection time of the electrical connectors to the flat cable.

It is, therefore, an object of the present invention to provide an electrical connector which may simultaneously terminate a bus and provide connection to a peripheral device.

It is another object of the present invention to provide an electrical connector and terminator package having a compact design which may be IDC connected to a flat ribbon cable.

It is a further object of the present invention to provide a terminator which includes a compact design which may be combined with an IDC connector.

SUMMARY OF THE INVENTION

A principal object of this invention is to provide a feed-thru insulation displacement connection (IDC) connector, including terminator circuitry, comprising a feed-thru connector, including a first end having IDC contacts protruding therefrom. A second end having feed-thru contacts connected to said IDC contacts. A circuit board interposed between said first end and second end and carrying said IDC contacts and said feed-thru contacts. The printed circuit board having an array of thru-holes. Each thru-hole having a mounting end of an IDC contact and a mounting end of a feed-thru contact seated therein. The feed-thru contacts being either male or female contacts. The printed circuit board, including termination circuitry, including resistors and capacitors mounted thereon.

The feed-thru IDC terminator, wherein the feed-thru contacts and the IDC contacts are mounted perpendicular to the circuit board. The feed-thru IDC terminator, wherein two rows of IDC contacts are mounted at the first end. The feed-thru IDC terminator, wherein two rows of feed-thru contacts are mounted at the second end. The feed-thru IDC terminator, wherein the feed-thru contacts and the IDC contacts include mounting ends, wherein the mounting end of the feed-thru contact and the mounting end of the IDC contact share the same thru-hole of the circuit board to provide electrical connection between the contacts.

A feed-thru electrical connector for providing connection and termination of a peripheral device to a bus comprising a housing, including a circuit board having termination circuitry thereon and feed-thru contacts mounted thereto. The housing mounted to a ribbon cable connected to a bus. The feed-thru electrical connector, wherein the housing includes IDC contacts for mounting the housing to the bus. The feed-thru electrical connector, wherein the IDC contacts are integral with the feed-thru contacts.

These and other features of the invention are set forth below in the following detailed description of the presently preferred embodiments.

DETAILED DESCRIPTION OF THE PRESENTLY PREYED EMBODIMENTS

Figures 1, 2, 3:
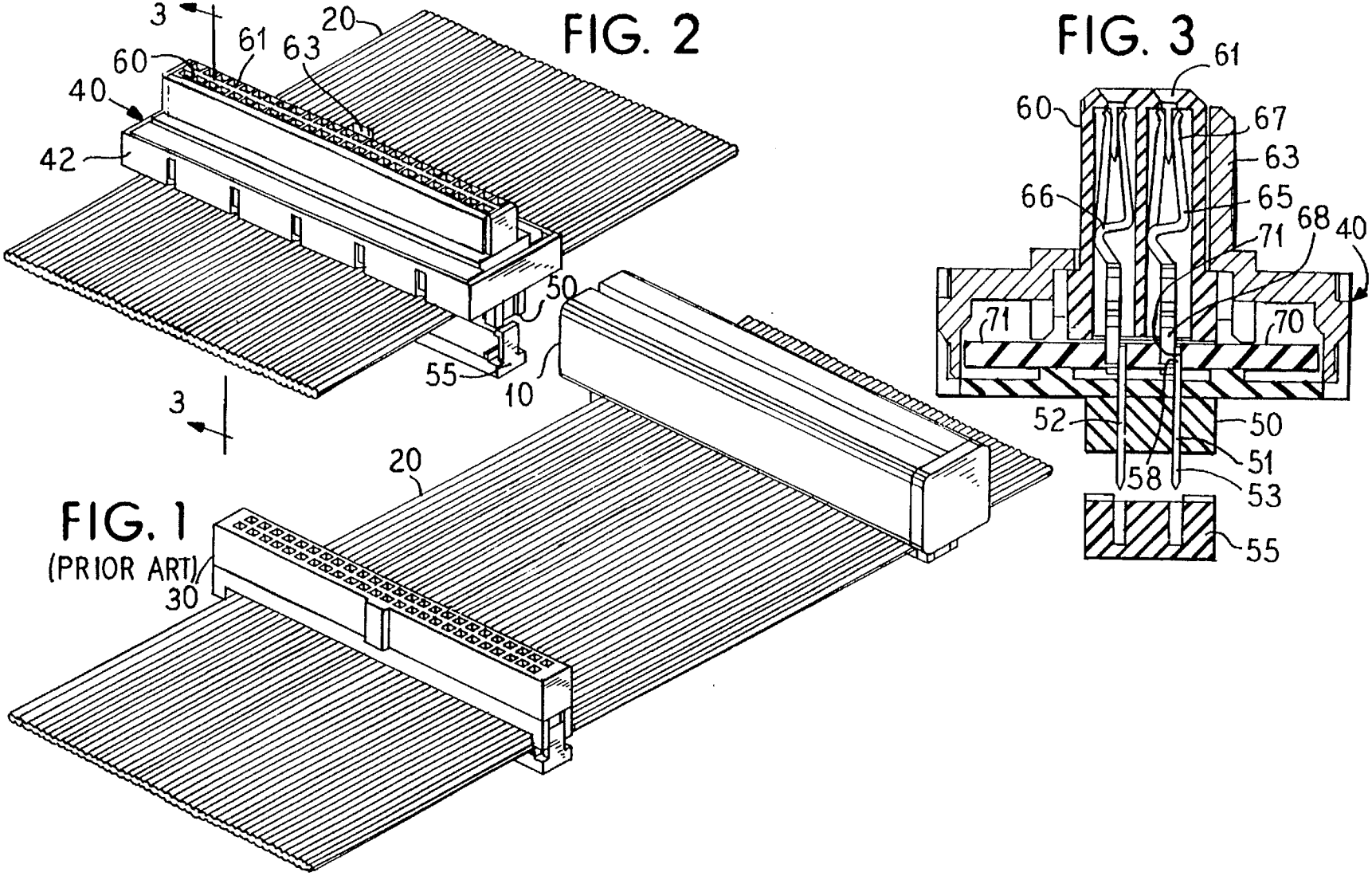
FIG. 1 (PRIOR ART)
FIG. 1 is a perspective view of the prior art showing a terminator separate from an electrical connector.
FIG. 2 is a perspective view of the present invention mounted to a flat ribbon cable.
FIG. 3 is a side-elevation cut-away view of the electrical connector of FIG. 2, taken at line 3—3.

The present invention relates to an electrical connector as best disclosed in FIGS. 2–3. Turning to FIG. 2, the feed-thru connector 40 is shown having a first end 50 and a second end 60. The first end 50 includes two rows of IDC contacts. The contacts in a preferred embodiment are formed with knifelike edges so that they may easily penetrate the insulation of the flat cable 20 and provide electrical connection between each conductor of the flat cable and the IDC contact. The feed-thru connector 40 is shown in its mounted position on the flat cable 20. An IDC cap 55 is then placed over the first end 50 of the feed-thru connector 40, in order to secure the feed-thru connector 40 to the flat cable 20 and also protect the protruding IDC contacts. The feed-thru connector 40 includes a housing 42 which encloses the first and second ends 50,60, as well as a printed circuit board therebetween. The printed circuit board carries circuitry to provide termination to the bus and the peripheral device to which the second end 60 is connected.

The second end 60 is shown in a preferred embodiment having female passages 61. The passages 61 may receive male contacts of a peripheral device. In an alternative embodiment, the second end 60 may also be configured to have male contacts protruding therefrom. In such an embodiment, the male contacts of the second end 60 of the electrical connector 30 will mate with female contacts of a peripheral device. Either male or female contacts of the second end 60 may be provided in order to mate most easily with the peripheral device. Also protruding from the second end 60 is a latch 63 which secures the feed-thru connector 40 to the mating portion of the peripheral device. Housed within the second end 60 are feed-thru contacts which are mounted to the printed circuit board, mounted within the housing 42 perpendicular to the contacts.

Turning to FIG. 3, the arrangement of the feed-thru connector 40 may be more clearly understood. A first end 50 includes IDC contacts 51,52. Although only one pair of contacts is shown in FIG. 3, it will be understood that the following description relates to multiple pairs of contacts arranged along the length of the feed-thru connector 40. Each of the IDC contacts 51,52 include a distal end 53 which is inserted perpendicularly through a flat cable (not shown). After mounting the feed-thru connector 40 to the flat cable, the IDC cap 55 is placed over the distal ends 53 of the IDC contacts 51,52; securing the flat cable therebetween. The mounting end 58 of the IDC contacts 51,52 opposite the distal end 53 is mounted in thru-holes 71 of the printed circuit board 70.

Feed-thru contacts 65,66 include female distal ends 67, adjacent passages 61. Upon insertion of a male connector of a peripheral device into passage 61, female distal end 67 will receive the male contact and flex outwardly and provide a friction fit providing an electrical connection between feed-thru contact 65 to the peripheral device. The mounting end 68 of the feed-thru contacts 65,66 are inserted in thru-holes 71 of the printed circuit board 70. The mounting end 68 of the feed-thru contacts 65,66 share the same thru-hole 71 of the printed circuit board 70 as the mounting end 58 of the IDC contacts 51,52. In a preferred embodiment, the thru-hole 71 is a plated thru hole. The mounting ends 58,68 of the feed-thru contact 65,66 and IDC contact 51,52, when placed side-by-side, have a combined diameter which is approximately equal to the diameter of the thru-hole 71. Thus, a friction fit of the mounting ends 58,68 of the contacts 51,52,65,66 are provided within the thru-hole 71. Following insertion of the mounting ends 58,68 of the contacts within the thru-hole 71, solder is applied thereto to affix the contacts to the printed circuit board and provide for electrical connection between the contacts 65 and 51 and also to the circuitry of the printed circuit board 70 and provide electrical connection thereto. The printed circuit board includes resistors and capacitors which may be mounted to the top 71 or bottom of the printed circuit board. The components mounted to the printed circuit board 70 may be connected to the thru-holes 71 by traces of the printed circuit board. It may now be seen that a compact multi-functional assembly has been achieved, wherein a single feed-thru connector 40 provides for connection of a peripheral device to a bus via the flat cable and simultaneously terminates the bus.

In an alternative embodiment, the female end 67 of the feed-thru contact 65 may be replaced with male ends so that the feed-thru connector may mate with a female connector of a peripheral device. It may be seen that due to the multi-functional aspects of the present invention, only a single IDC need be made to the flat ribbon cable. Upon connection of the feed-thru connector 40 to the flat cable, it is ready for simultaneous connection and termination to a peripheral device. It may also be seen that by the present design, having the contacts mounted to the printed circuit board by sharing the same thru-holes, the assembly of the feed-thru connector 40 may be accomplished quickly and inexpensively. Further, the present design allows for large mounts of pressure to be exerted upon the feed-thru connector 40 during the IDC procedure without deforming or destroying the contacts and electrical connection provided therein.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. A feed-thru IDC terminator comprising:

a first end having IDC contacts protruding therefrom;

a second end having feed-thru contacts therein;

a circuit board between said IDC contacts and said feed-thru contacts having termination circuitry thereon; and said feed-thru contacts and said IDC contacts are distinct and include mounting ends, wherein said mounting end of said feed-thru contact and said mounting end of said IDC contact share the same thru-hole of said circuit board and are electrically connected.

2. The feed-thru IDC terminator of claim 1 wherein said circuit board includes thru-holes having mounted therein said feed-thru contacts and said IDC contacts.

3. The feed-thru IDC terminator of claim 1 wherein said feed-thru contacts and said IDC contacts are mounted perpendicular to said circuit board.

4. The feed-thru IDC terminator of claim 1 wherein two rows of IDC contacts are mounted at said first end.

5. The feed-thru IDC terminator of claim 1 wherein two rows of feed-thru contacts are mounted at said second end.

6. The feed-thru IDC terminator of claim 1 wherein second end includes female contacts.

7. The feed-thru IDC terminator of claim 1 wherein said second end includes male contacts.

8. A feed-thru IDC terminator comprising:

a first end having IDC contacts protruding therefrom;

a second end having feed-thru contacts therein;

a circuit board between and perpendicular to said IDC contacts and said feed-thru contacts and said IDC contacts and said feed-thru contacts are distinct and are mounted in thru-holes of said circuit board having termination circuitry thereon; and said feed-thru contacts and said IDC contacts include mounting ends wherein said mounting end of said feed-thru contact and said mounting end of said IDC contact share the same thru-hole of said circuit board and are electrically connected.

9. A method of terminating a bus comprising the steps of:

positioning a flat ribbon cable adjacent a first end of a feed-thru connector having IDC contacts protruding from said first end, said feed-thru connector having feed-thru contacts distinct from said IDC contacts mounted perpendicular to a circuit board in a through hole and mounting ends of pairs of the IDC contacts and the feed-thru contacts are electrically connected and share the same said through hole and the circuit board having circuitry thereon for providing termination of said bus connected to said flat ribbon cable;

mounting said feed-thru connector to said flat ribbon cable via an IDC operation wherein a distal end of said IDC contact penetrates insulation of said flat ribbon cable to make electrical contact with a corresponding conductor of said flat ribbon cable; and mating said feed-thru connector to a peripheral device.

10. The method of claim 9, including the step of attaching an IDC cap over said distal ends of said IDC contacts wherein said feed-thru connector is secured to said flat ribbon cable.

* * * * *